US005450697A

United States Patent [19]

Prucinsky et al.

[11] Patent Number: 5,450,697

[45] Date of Patent: Sep. 19, 1995

[54] REMOVABLE CYLINDER LOCKED MULLION ASSEMBLY

[75] Inventors: Matthew S. Prucinsky; Richard B. Cohrs; Roger A. Vitt, all of Indianapolis, Ind.

[73] Assignee: Von Duprin, Inc., Indianapolis, Ind.

[21] Appl. No.: 229,894

[22] Filed: Apr. 19, 1994

[51] Int. Cl.[6] ..... G06B 1/04; E06R 5/00

[52] U.S. Cl. ..... 52/210; 49/365; 70/58; 52/204.1; 52/777

[58] Field of Search ..... 52/127.11, 127.7, 210, 52/204.1, 777, 821; 70/57, 58, 65, 101; 49/365

[56] References Cited

U.S. PATENT DOCUMENTS

| | | | |
|---|---|---|---|
| 1,908,165 | 5/1933 | Moler | 49/365 |
| 2,062,899 | 12/1936 | Morris | 49/365 |
| 2,309,436 | 1/1943 | Blodgett | 49/365 |
| 3,939,678 | 2/1976 | Wagoner | 70/57 |
| 4,057,984 | 11/1977 | Audiushi | 70/58 |
| 4,438,550 | 3/1984 | Oda | 70/57 |
| 4,880,059 | 11/1989 | Brandell et al. | 166/332 |
| 4,949,788 | 8/1990 | Szarka et al. | 166/285 |
| 4,949,793 | 8/1990 | Rubbo et al. | 166/382 |
| 4,974,890 | 12/1990 | Cohrs | 292/336.3 |
| 4,991,654 | 2/1991 | Brandell et al. | 166/332 |

FOREIGN PATENT DOCUMENTS

| | | |
|---|---|---|
| 0427422A2 | 5/1991 | European Pat. Off. . |
| 0427423A2 | 5/1991 | European Pat. Off. . |
| 2232178 | 12/1990 | United Kingdom . |
| 2240798 | 8/1991 | United Kingdom . |

*Primary Examiner*—Carl D. Friedman
*Assistant Examiner*—W. Glenn Edwards
*Attorney, Agent, or Firm*—Robert F. Palermo; A. James Richardson

[57] ABSTRACT

A mullion assembly mountable between a floor and a door frame includes an engagement assembly attached to either the floor or the door frame. A mullion defining a mullion cavity is positioned in removable attachment with the engagement assembly, and a cylinder lock assembly is positioned in the mullion cavity. The cylinder lock assembly has a key lock cylinder configured for positioning in either a locked position to engage the engagement assembly and hold the mullion in an upright position in the door frame, or in an unlocked position disengaged from the engagement assembly to permit removal of the mullion from the doorway.

11 Claims, 8 Drawing Sheets

REMOVABLE CYLINDER LOCKED MULLION ASSEMBLY

BACKGROUND OF THE INVENTION

The present invention relates to a removable mullion assembly for a double door. More particularly, the present invention relates to a removable mullion assembly controlled by a key cylinder lock mechanism.

Mullions are vertically oriented doorway inserts that allow use of single doors in double door frames. Conventionally, mullions are centered in a double doorway and attached with screws or bolts to fittings inset into the floor and the top of the door frame. Two strikes are provided on opposing sides of the mullion to accommodate latches of two single size doors that are respectively hinge mounted on opposite side of the door frame.

When unobstructed access through the double door is needed, conventional mullions must be unscrewed or unbolted from the inset fittings. This can be time consuming and difficult procedure, and normally requires two people. One person must hold the mullion while the other person unscrews or unbolts the mullion from the fittings. However, repeated removal and replacement of the mullion can also cause problems, with the fittings tending to become loose with time, or screw threads being stripped or damaged.

To overcome this problem, removable mullions that do not require unscrewing or unbolting have been disclosed. For example, U.S. Pat. No. 2,275,730 discloses a mullion capable of being seated in a floor bracket and swung forward to permit a latch bolt to snap into abutting relation with a tooth, holding the mullion in position against a top bracket. The mullion can be released by an actuating chain that retracts the latch bolt into a housing beneath the tooth, permitting inward tilting and complete removal of the mullion.

However, mullion assemblies known in the prior art are disadvantageous for many applications because the mullion release system is not protected against damage or unauthorized removal by vandals. What is needed is an easily pivoted mullion assembly that can be snapped into an upright position to secure hinged doors, does not require multiple persons to remove or align, and is not removable by unauthorized persons.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully described hereinafter.

SUMMARY OF THE INVENTION

The present invention uses a key controlled lock mechanism to provide such a vandal resistant mullion assembly. A mullion assembly in accordance with the present invention includes a retaining element attached to the door frame and an engagement assembly attached to a floor below the retaining element. A mullion, defining therethrough a mullion cavity, is positionable in removable attachment between the retaining element and the engagement assembly. A cylinder lock assembly is positioned in the mullion cavity, with the cylinder lock assembly having a key lock cylinder configured for positioning in a locked position to engage the engagement assembly and hold the mullion in an upright position in the door frame, and in an unlocked position disengaged from the engagement assembly to permit removal of the mullion from the doorway.

In preferred embodiments, the engagement assembly of the mullion assembly further includes an upwardly projecting flange. This flange has a flange aperture defined within it, with the flange aperture positioned to accommodate the key lock cylinder in locking engagement. The cylinder lock assembly includes a compression spring connected between the key lock cylinder and the flange of the engagement assembly, with the compression spring being biased to force the key lock cylinder out of the flange aperture. When the mullion assembly is locked in an upright position, this biasing force exerted by the spring is resisted by a cylinder cam attached to the key lock cylinder. The cylinder cam is rotatable by a key to engage an abutment defined by the engagement assembly, preventing retraction of the cylinder lock assembly from its locked position within the flange aperture.

In certain embodiments, the cylinder lock assembly does not directly engage the flange aperture, but instead acts though an intermediary coupling mechanism. For example, the cylinder lock assembly can further include a cylinder cam rotatable by a key to contact and extend a bolt lockingly engagable with the engagement assembly. Rotation of a key in the key cylinder causes alternate extension or retraction of the bolt to respectively engage with or disengage from the flange aperture.

Further features, objects, and advantages of the present invention will become more apparent upon consideration of the accompanying claims, drawings, and the following description of those drawings.

DETAILED DESCRIPTION OF THE INVENTION

Figure 1:
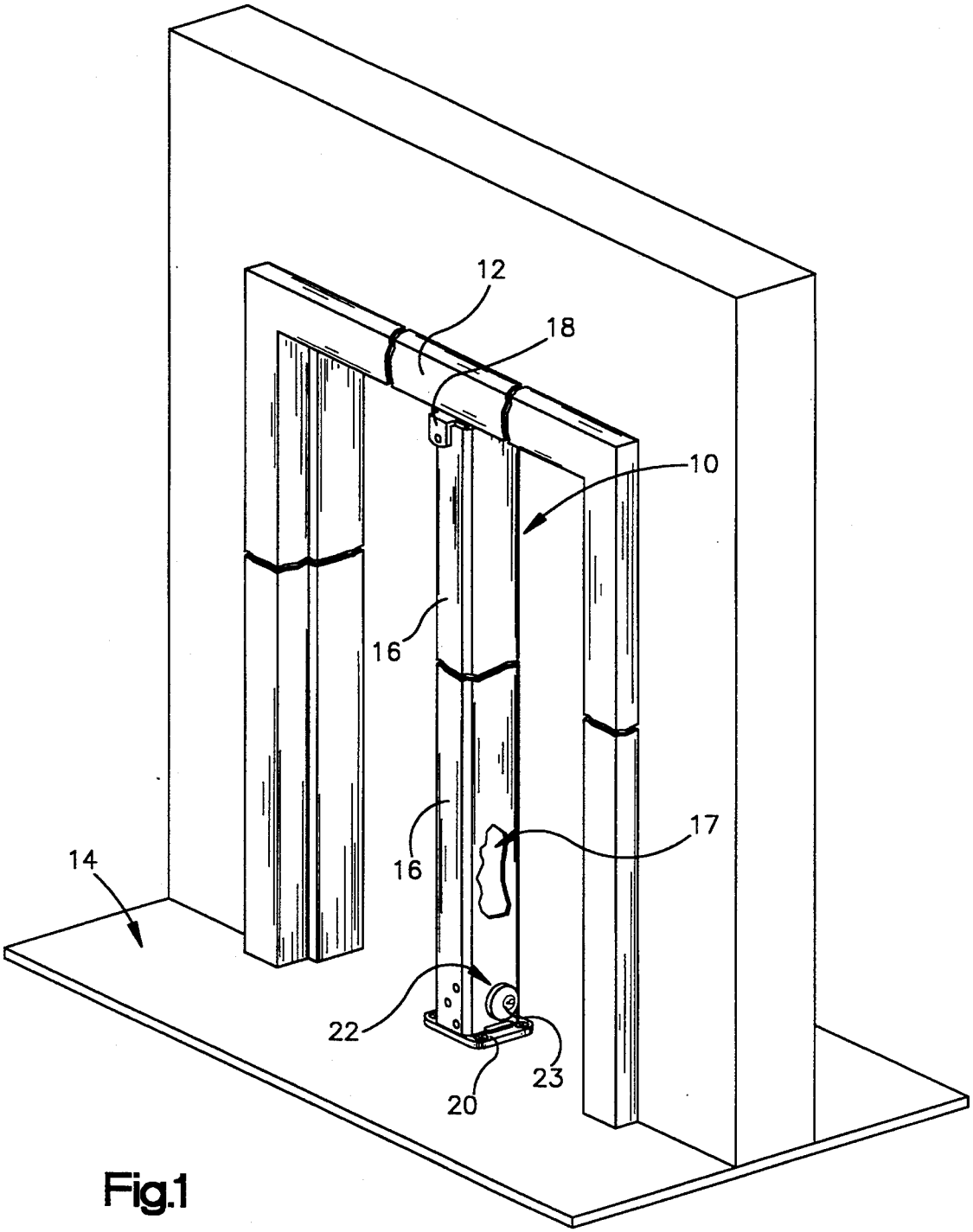
FIG. 1 is a perspective view of a double door frame having a mullion assembly in accordance with the present invention, the mullion assembly being mounted between a retaining element and an engagement assembly respectively positioned at the top and bottom center of the door frame in the illustrated embodiment.

As shown in FIG. 1, a mullion assembly 10 is installed between a standard double door frame 12 and a floor 14. The mullion assembly 10 includes a mullion 16 that is fitted between a retaining element 18 and an engagement assembly 20. The retaining element 18 is permanently attached to the door frame 12 (as illustrated) or the floor, and is configured to have several projections (not shown) that guide placement of the mullion and prevent its dislodgement when the mullion is positioned in an upright, locked position.

Figure 3:
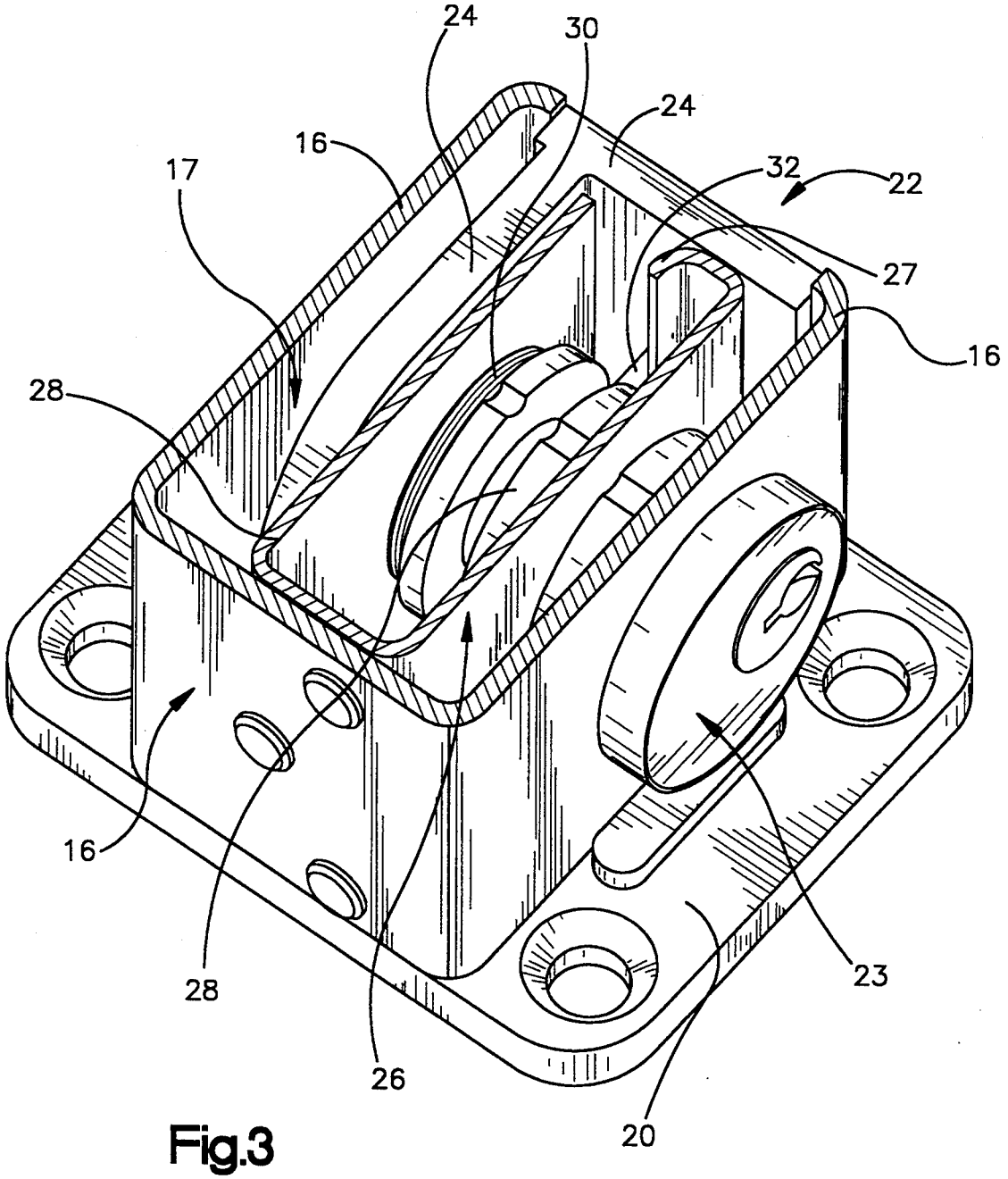
FIG. 3 is a perspective, broken away view of the mullion assembly, illustrating the locked connection between the engagement assembly attached to the floor, the mullion, and the cylinder lock assembly positioned within the mullion to control engagement of the mullion with the engagement assembly.
Figure 4:
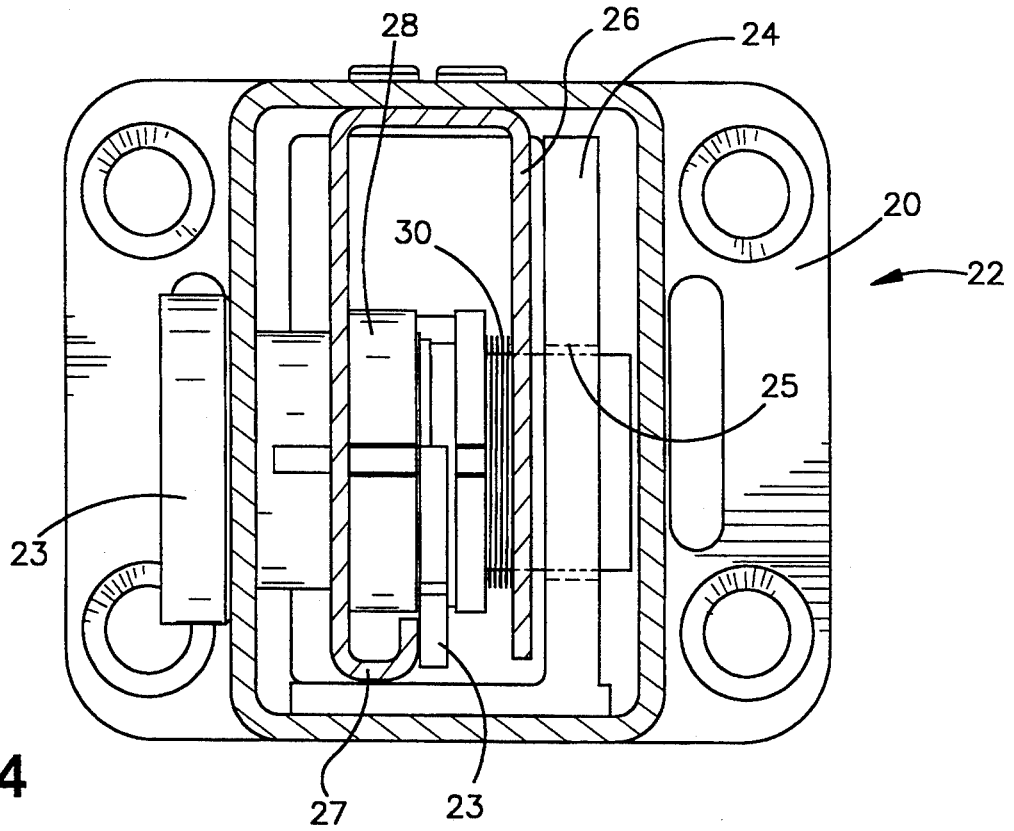
FIG. 4 is a top, cutaway view of the mullion assembly of FIG. 3, shown in its locked position.
Figure 5:
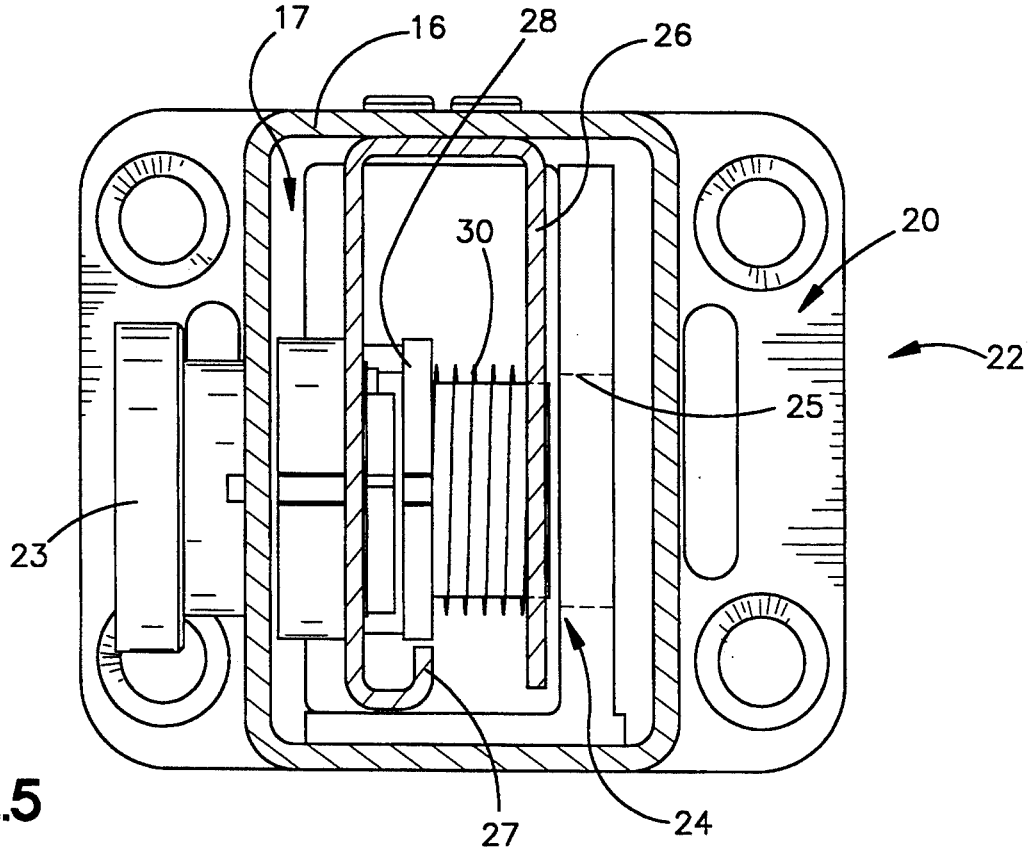
FIG. 5 is a top, cutaway view of the mullion assembly of FIG. 4, shown in an unlocked position with a key lock cylinder of the cylinder lock assembly withdrawn from its locked connection with a flange projecting from the engagement assembly.

The engagement assembly 20 is also permanently affixed to either the floor (as illustrated) or the door frame, directly opposite the retaining element 18. As best seen in FIGS. 3, 4, and 5, the engagement assembly 20 has an upwardly projecting flange 24 that defines a flange aperture 25 passing therethrough. The engagement assembly 20 also includes a sleeve bracket 26 that terminates at one end with an abutment 27.

As best seen in FIGS. 1 and 3, the mullion 16 defines a mullion cavity 17 that can be fitted over the engagement assembly 20. The mullion 16 can be constructed from steel or aluminum by conventional techniques such as extrusion, stamping, folding or other known metal working techniques. As best seen with reference to FIGS. 3, 4, and 5, the cavity 17 is also sized to hold cylinder lock assembly 22, which includes a key lock cylinder 23, cylinder sleeve 28, and compression spring 30. The compression spring 30 engages both the flange 24 and the key lock cylinder 23, being normally biased to urge the key lock cylinder out of its locked position passing through the flange aperture 25. This spring force is resisted by a cylinder cam 32 that can be rotated by a key to engage abutment 27, effectively locking the cylinder lock assembly 22 and the attached mullion 16 to the flange 24 of the engagement assembly.

Figure 2:
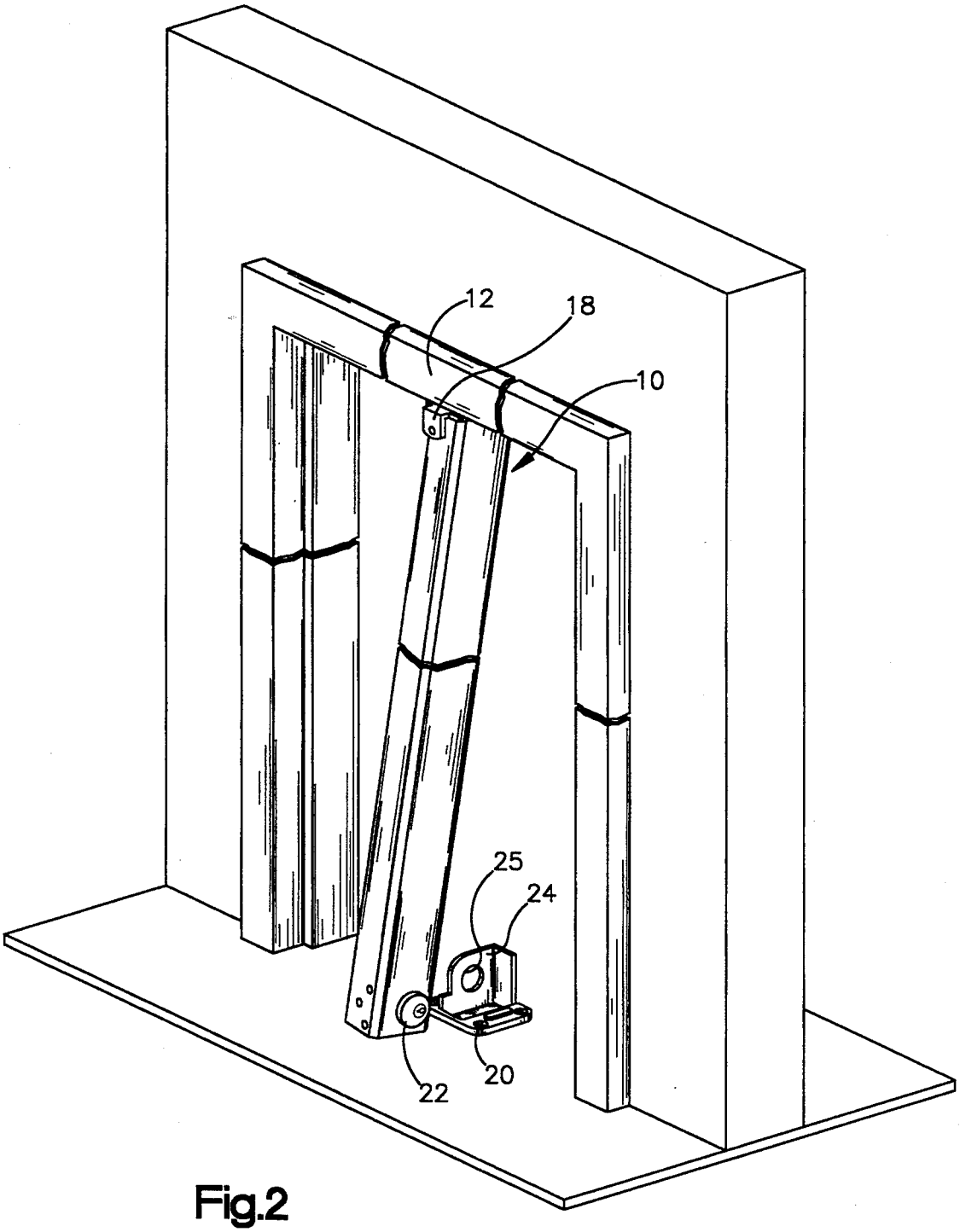
FIG. 2 is a perspective view of the mullion assembly of FIG. 1, the mullion assembly being rotated away from the engagement assembly after disengagement of the mullion through activation of a cylinder lock assembly.

In operation, as seen with reference to FIGS. 4 and 5, release of the mullion 16 from the retaining element 18 and engagement assembly 20 follows in response to activation of key lock cylinder 23. This release is simple and secure, with a key turn breaking the locked connection between the cylinder lock assembly 22 and the engagement assembly 20. In this locked position (FIGS. 1 and 4), the cylinder lock assembly 22 projects through the flange aperture 25 of the flange, and is maintained in position against the force of compression spring 30 by the engagement between the cylinder cam 32 and the abutment 27 of the engagement assembly 20. However, when a key (not shown) is used to rotate the cylinder cam 32 away from contact with the abutment 27, the compression spring 30 expands, pushing the key lock cylinder out of the flange aperture as seen in FIG. 5. This breaks the connection between the mullion 16 and the engagement assembly 20, and allows the mullion 16 to be rotated out of its vertical, locked position and removed to improve doorway access (FIG. 2). Replacement of the mullion 16 is also simple and efficient, with the mullion being maneuvered into position, the key lock cylinder 23 being forced inward until it passes through the flange aperture 25, and a key rotating the cylinder cam 32 until it engages the abutment 27 of the engagement assembly.

As will be appreciated by those skilled in the art, alternative mechanisms for engaging the engagement assembly are also possible, including bolts, latches, or other throw mechanisms triggered by rotation of the cylinder cam to engage the engagement assembly. In addition, as those skilled in the art will appreciate, it is also possible to reverse the orientation of the mullion by positioning the cylinder assembly and engagement assembly near the doorway. An example of such an alternative embodiment having an engagement assembly adjacent to the top of the doorway and an auxiliary mechanism for throwing an engagement bolt upon rotation of a key lock cylinder is illustrated by FIGS. 6–9.

Figure 6:
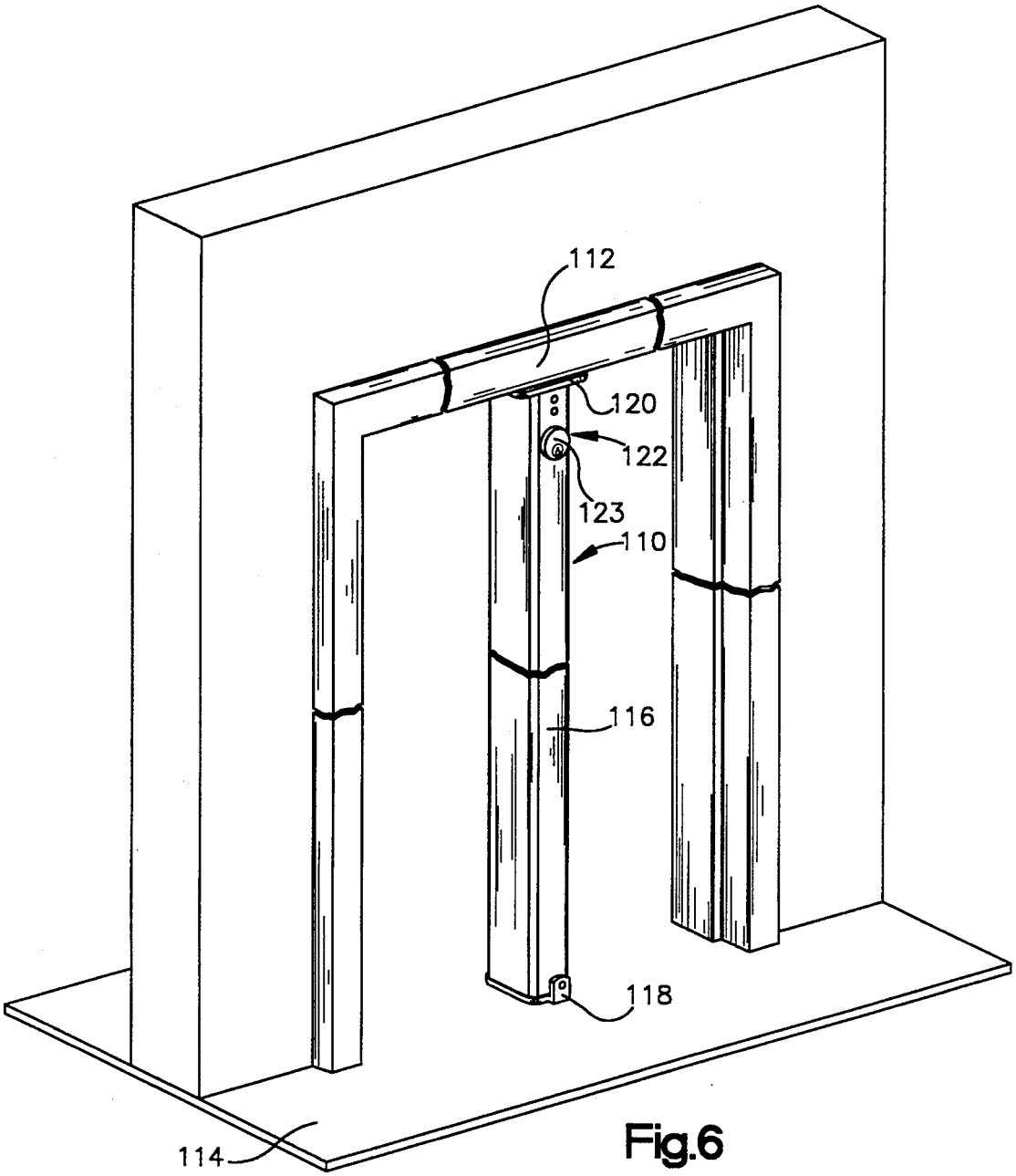
FIG. 6 is a perspective view of a double door frame having an alternative embodiment of a mullion assembly in accordance with the present invention, the mullion assembly being mounted between an engagement assembly and a retaining element respectively positioned at the top and bottom center of the door frame and having a cylinder lock assembly positioned adjacent to the engagement assembly at the top of the door frame.
Figure 7:
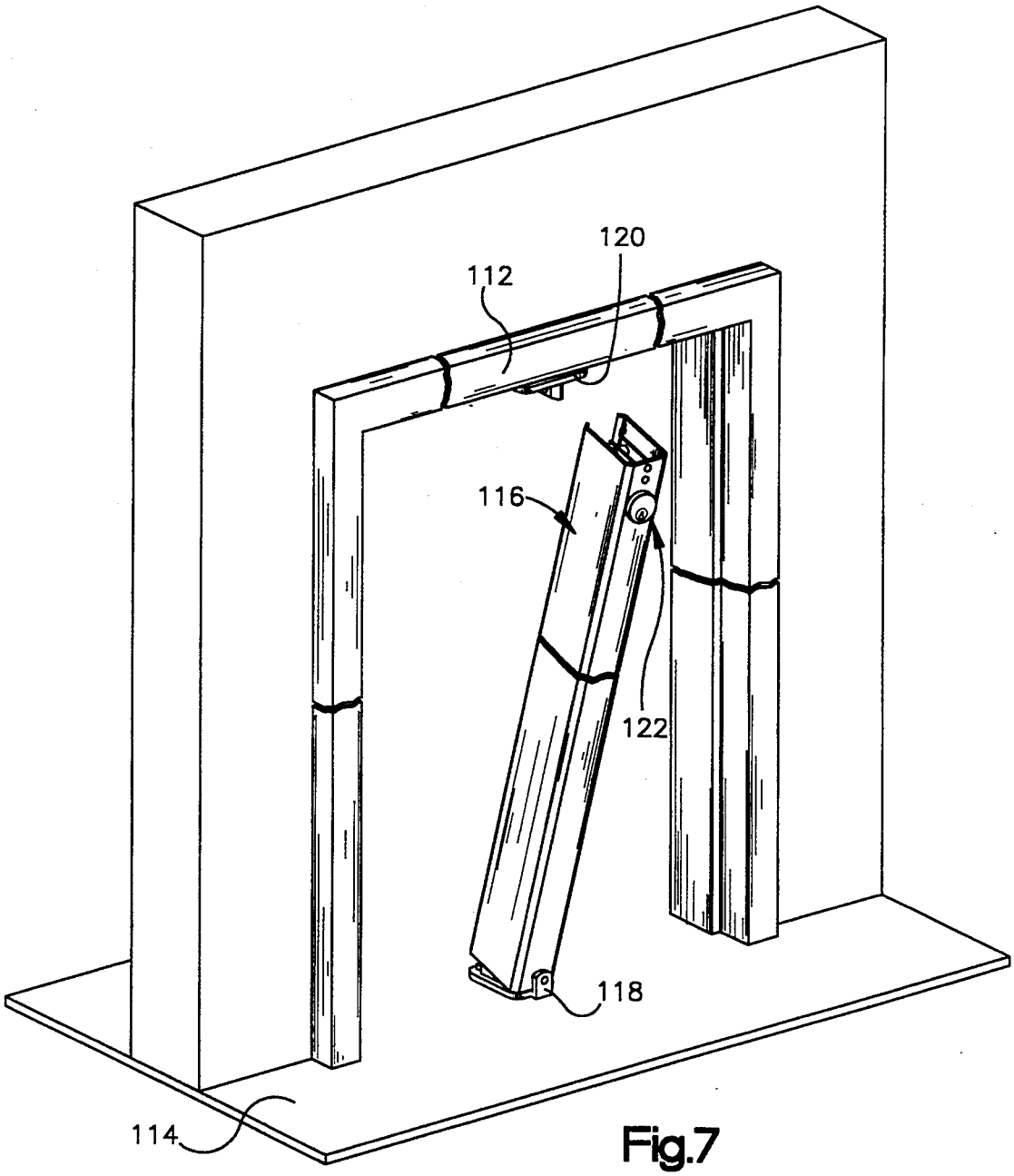
FIG. 7 is a perspective view of the mullion assembly of FIG. 6, the mullion assembly being rotated away from an engagement assembly after disengagement of the mullion through activation of the cylinder lock assembly.

FIGS. 6 and 7 illustrate an embodiment of the invention that substantially corresponds to the embodiment previously illustrated and described with reference to FIGS. 1 and 2, with the exception that a mullion 116 engages a retaining element 118 attached to a floor 114, and an engagement assembly 120 (having a substantially different configuration best seen in FIG. 8 and 9) attached to a door frame 112. A cylinder lock assembly 122 having a key lock cylinder 123 is used to control locking and unlocking of the mullion 116.

Figure 8:
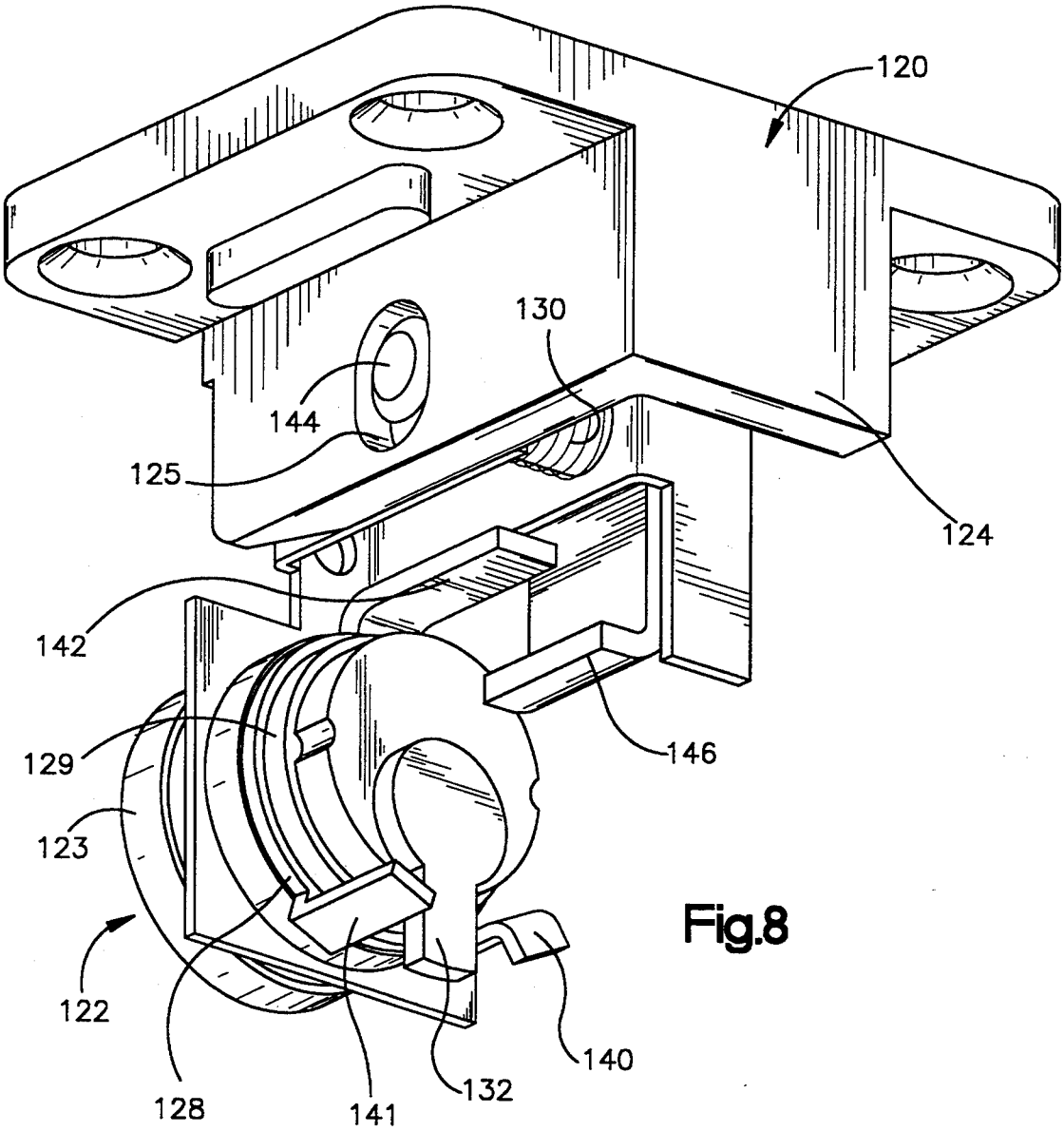
FIG. 8 is a perspective, cutaway view of the mullion assembly of FIG. 7, shown in its locked position with the mullion removed for clarity.
Figure 9:
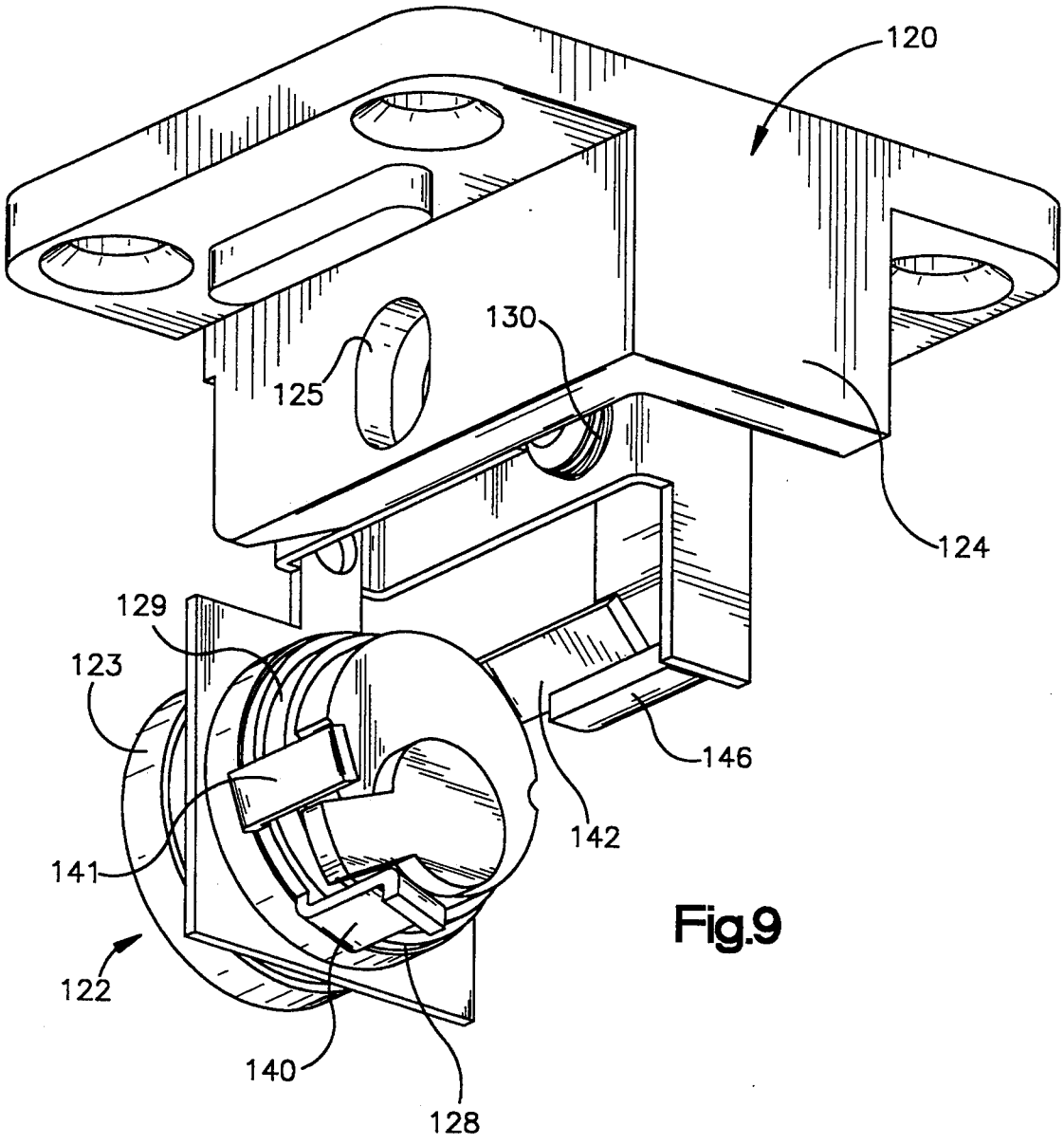
FIG. 9 is a perspective, cutaway view of the mullion assembly of FIG. 8, shown in an unlocked position.

FIG. 8 is a view of the engagement assembly 120 and the cylinder lock assembly 122 in locked engagement, with the mullion 116 not shown for clarity. As illustrated, the cylinder lock assembly 122 includes a cylinder cam 132 that can be rotated to engage a first arm 140 or a second arm 141 attached to a rotatable cylinder sleeve 128, which is held in place by a retaining nut 129. In its normally locked position, a bolt 144 extends through a flange aperture 125 in response to bias of a spring 130 attached to the bolt 144 and a flange 124. The bolt is integrally attached to a plate 146 that downwardly extends toward the cylinder lock assembly 122. Locking engagement between the cylinder lock assembly 122 (and its attached mullion, not shown) and the engagement assembly 120 can be broken simply by turning a key. As illustrated in FIG. 9, the cylinder 123 rotates, causing in turn rotation of the second arm 141 of the cylinder sleeve 128. Rotation of the cylinder sleeve 128 causes an attached third arm 142 to engage and downwardly impel the plate 146. This action in turn forces the bolt 144 out of its engagement with the flange 124 by causing it to withdraw from the flange aperture 125. Reversal of this process by rotating a key in the opposite direction causes the cylinder lock assembly to again engage the engagement assembly 120, with the cylinder cam 132 rotating the first arm 140 and connected cylinder sleeve 128, causing the third arm 142 to move out of contact with plate 146, and regain the locked engagement position seen in FIG. 8.

While the present invention has been described in connection with certain specific embodiments, it should be understood that the specific examples are not intended to limit the invention as set forth in the following claims.

What is claimed is:

1. A mullion assembly mountable in a door frame, the mullion assembly comprising:

a retaining element attachable to the door frame, an engagement assembly attachable to a floor below the retaining element;

a mullion defining a mullion cavity, the mullion being positionable in removable attachment between the retaining element and the engagement assembly;

a cylinder lock assembly positioned in the mullion cavity, the cylinder lock assembly having a key lock cylinder configured for translational movement along the axis of the key lock cylinder between a locked position to engage the engagement assembly and hold the mullion in an upright position in the door frame, and an unlocked position disengaged from the engagement assembly to permit removal of the mullion from the doorway.

2. The mullion assembly of claim 1, wherein the engagement assembly further comprises a flange defining therethrough a flange aperture, with the flange aperture positioned to accommodate the key lock cylinder in locking engagement.

3. The mullion assembly of claim 2, wherein the cylinder lock assembly further comprises a compression spring connected between the key lock cylinder and the flange of the engagement assembly, the compression spring being biased to force the key lock cylinder out of the flange aperture.

4. The mullion assembly of claim 3, wherein the cylinder lock assembly further comprises a cylinder cam rotatable by a key to engage an abutment defined by the engagement assembly.

5. A mullion assembly mountable between a floor and a door frame, the mullion assembly comprising:

an engagement assembly attachable to at least one of the floor and the door frame;

a mullion defining a mullion cavity, the mullion being positionable in removable attachment with the engagement assembly;

a cylinder lock assembly positioned in the mullion cavity, the cylinder lock assembly having a key lock cylinder configured for translational movement along the axis of the key lock cylinder between a locked position to engage the engagement assembly and hold the mullion in an upright position in the door frame, and an unlocked position disengaged from the engagement assembly to permit removal of the mullion from the doorway.

6. The mullion assembly of claim 5, wherein the engagement assembly further comprises a flange defining therethrough a flange aperture, with the flange aperture positioned to accommodate the key lock cylinder in locking engagement.

7. The mullion assembly of claim 6, wherein the cylinder lock assembly further comprises a compression spring connected between the key lock cylinder and the flange of the engagement assembly, the compression spring being biased to force the key lock cylinder out of the flange aperture.

8. The mullion assembly of claim 7, wherein the cylinder lock assembly further comprises a cylinder cam rotatable by a key to engage an abutment defined by the engagement assembly.

9. The mullion assembly of claim 5, wherein the cylinder lock assembly further comprises a cylinder cam rotatable by a key to contact and extend a bolt lockingly engagable with the engagement assembly.

10. A mullion assembly mountable between a floor and a door frame, the mullion assembly comprising:

means for engaging attachable to at least one of the floor and the door frame, the engaging means having a bolt configured to engage a flange aperture defined in a flange;

a mullion defining a mullion cavity, the mullion being positionable in removable attachment with the engaging means;

a cylinder lock assembly positioned in the mullion cavity, the cylinder lock assembly having a key lock cylinder configured for positioning in a locked position to engage the engaging means and hold the mullion in the door frame, and in an unlocked position disengaged from the engaging means to permit removal of the mullion from the doorway, with the bolt extendible and retractable in response to rotational movement of a cylinder cam attached to the key lock cylinder.

11. A mullion assembly mountable between a floor and a door frame, the mullion assembly comprising:

a retaining element attachable to the floor;

an engagement assembly attachable to the door frame above the retaining element, the engagement assembly having a flange defining therethrough a flange aperture;

a mullion defining a mullion cavity, the mullion being positionable in removable attachment between the retaining element and the engagement assembly;

a cylinder lock assembly positioned in the mullion cavity, the cylinder lock assembly having a key lock cylinder configured for rotation to a locked position to engage the engagement assembly and hold the mullion in an upright position in the door frame, and in an unlocked position disengaged from the engagement assembly to permit removal of the mullion from the doorway, with the flange aperture positioned to accommodate a bolt in locking engagement, with the bolt movable into position by rotation of the key lock cylinder.

* * * * *